US008322176B2

(12) United States Patent
Johnson et al.

(10) Patent No.: US 8,322,176 B2
(45) Date of Patent: Dec. 4, 2012

(54) SYSTEM AND METHOD FOR INCREMENTALLY FORMING A WORKPIECE

(75) Inventors: Carl Frederick Johnson, Belleville, MI (US); Vijitha Senaka Kiridena, Ann Arbor, MI (US); Feng Ren, Canton, MI (US); Zhiyong Cedric Xia, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 681 days.

(21) Appl. No.: 12/369,336

(22) Filed: Feb. 11, 2009

(65) Prior Publication Data

US 2010/0199742 A1 Aug. 12, 2010

(51) Int. Cl.
*B21D 17/04* (2006.01)
*B21D 3/02* (2006.01)

(52) U.S. Cl. ..... 72/75; 72/115

(58) Field of Classification Search ..... 72/75, 115, 72/220, 386; 228/112.1, 114.5, 2.1, 2.3
See application file for complete search history.

(56) References Cited

U.S. PATENT DOCUMENTS 2,945,528 A * 7/1960 Roux ..... 72/297
3,342,051 A * 9/1967 Leszak ..... 72/81
4,212,188 A * 7/1980 Pinson ..... 72/413
4,337,566 A * 7/1982 DiMatteo et al. ..... 29/558
4,802,357 A * 2/1989 Jones ..... 72/17.3
4,976,125 A * 12/1990 Wilson ..... 72/21.1
5,151,277 A * 9/1992 Bernardon et al. ..... 425/112
5,187,969 A * 2/1993 Morita ..... 72/413
5,364,083 A * 11/1994 Ross et al. ..... 269/21
5,392,663 A 2/1995 Charles
5,471,856 A * 12/1995 Suzuki et al. ..... 72/1
5,546,784 A * 8/1996 Haas et al. ..... 72/413
5,903,458 A * 5/1999 Stewart et al. ..... 700/98
5,943,750 A * 8/1999 Koren et al. ..... 29/26 A
6,012,314 A * 1/2000 Sullivan et al. ..... 72/14.8
6,050,474 A * 4/2000 Aota et al. ..... 228/112.1
6,053,026 A * 4/2000 Nardiello et al. ..... 72/413
6,068,464 A * 5/2000 Su et al. ..... 425/190
6,089,061 A * 7/2000 Haas et al. ..... 72/14.8
6,151,938 A * 11/2000 Park et al. ..... 72/57
6,209,380 B1 * 4/2001 Papazian et al. ..... 72/413
6,216,508 B1 * 4/2001 Matsubara et al. ..... 72/43

(Continued)

FOREIGN PATENT DOCUMENTS

EP 1 731 238 12/2006

(Continued)

OTHER PUBLICATIONS

"Dieless Incremental Sheet Metal Forming Technology," Applied Plasticity Research Group, publication date unknown.

(Continued)

*Primary Examiner* — Dana Ross
*Assistant Examiner* — Lawrence J Averick
(74) *Attorney, Agent, or Firm* — Damian Porcari; Brooks Kushman P.C.

(57) ABSTRACT

A system and method for incrementally forming a workpiece. A first manipulator is configured to move a first tool in multiple directions along a first surface of a workpiece. A second manipulator is configured to move a second tool in multiple directions along a second surface of the workpiece. The first and second tools move along first and second predetermined paths of motion and exert force to form the workpiece.

20 Claims, 2 Drawing Sheets

U.S. PATENT DOCUMENTS

| | | | | |
|---|---|---|---|---|
| 6,237,829 | B1 * | 5/2001 | Aota et al. | 228/2.1 |
| 6,298,896 | B1 * | 10/2001 | Sherrill et al. | 156/581 |
| 6,419,142 | B1 * | 7/2002 | Larsson | 228/2.1 |
| 6,484,776 | B1 * | 11/2002 | Meilunas et al. | 156/382 |
| 6,505,492 | B2 * | 1/2003 | Jroski | 72/348 |
| 6,532,786 | B1 * | 3/2003 | Luttgeharm | 72/115 |
| 6,561,002 | B2 * | 5/2003 | Okada et al. | 72/115 |
| 6,578,399 | B1 * | 6/2003 | Haas et al. | 72/57 |
| 6,748,780 | B1 * | 6/2004 | Luttgeharm | 72/115 |
| 6,761,785 | B2 * | 7/2004 | Sherrill et al. | 156/212 |
| 6,823,705 | B2 * | 11/2004 | Fukuda et al. | 72/214 |
| 6,947,809 | B2 * | 9/2005 | Ren et al. | 700/163 |
| 6,971,256 | B2 | 12/2005 | Okada et al. | |
| 7,079,996 | B2 * | 7/2006 | Stewart et al. | 703/8 |
| 7,117,065 | B1 * | 10/2006 | Xia et al. | 700/146 |
| 7,437,809 | B2 * | 10/2008 | Yamamoto et al. | 29/26 A |
| 7,448,528 | B2 * | 11/2008 | Forrest et al. | 228/112.1 |
| 7,467,532 | B2 * | 12/2008 | Golovashchenko | 72/56 |
| 7,536,892 | B2 * | 5/2009 | Amino et al. | 72/305 |
| 7,712,522 | B2 * | 5/2010 | Shuster et al. | 166/207 |
| 7,971,463 | B2 * | 7/2011 | Forrest et al. | 72/67 |
| 7,971,643 | B2 * | 7/2011 | Brannon et al. | 166/280.1 |
| 8,033,151 | B2 * | 10/2011 | Castle et al. | 72/53 |
| 2002/0158109 | A1 * | 10/2002 | Gendoh et al. | 228/112.1 |
| 2002/0190103 | A1 * | 12/2002 | Yoshinaga | 228/112.1 |
| 2003/0154757 | A1 * | 8/2003 | Fukuda et al. | 72/214 |
| 2003/0209586 | A1 * | 11/2003 | Thompson | 228/103 |
| 2004/0148997 | A1 * | 8/2004 | Amino et al. | 72/297 |
| 2004/0187548 | A1 * | 9/2004 | Okada et al. | 72/379.2 |
| 2006/0272378 | A1 | 12/2006 | Amino et al. | |
| 2007/0202778 | A1 * | 8/2007 | Toyoshima et al. | 451/42 |
| 2008/0093760 | A1 * | 4/2008 | Harper et al. | 264/40.1 |
| 2008/0302154 | A1 * | 12/2008 | Forrest et al. | 72/69 |
| 2009/0226272 | A1 * | 9/2009 | Smith et al. | 409/80 |
| 2010/0030362 | A1 * | 2/2010 | Paik | 700/110 |
| 2010/0252172 | A1 * | 10/2010 | Baumann et al. | 156/73.5 |
| 2010/0257909 | A1 * | 10/2010 | Huskamp et al. | 72/21.1 |

FOREIGN PATENT DOCUMENTS

| | | | |
|---|---|---|---|
| EP | 1899089 | | 3/2008 |
| WO | WO 2006/110962 | A2 * | 4/2006 |

OTHER PUBLICATIONS

"Dieless NC Forming," www.the fabricator.com, by Taylan Altan, Jun. 12, 2003.

"Dieless Sheet Forming," Se-Prof Technology Services Ltd., printed Oct. 16, 2008, publication date unknown.

"Octahedral Hexapod Design Promises Enhanced Machine Performance," Ingersoll Milling Machine Company, printed Oct. 7, 2008, publication date unknown.

"A Computer Numerically Controlled Dieless Incremental Forming of a Sheet Metal," by S. Matsubara, University of Industrial Technology, Sagamihara-shi, Japan, May 25, 2001.

"Incremental Forming of Sheet Metal," by J. Cao, V. Reddy and Y. Wang, Northwestern University, publication date unknown.

"Sheet Metal Dieless Forming and its tool path generation based on STL files," by L. Jie, M. Jianhua, and H. Shuhuai; Springer London, Feb. 19, 2004.

"A review of conventional and modern single-point sheet metal forming methods," by E. Hagan and J. Jeswiet, Queen's University, Kingston, Ontario, Canada, Sep. 19, 2002.

"Investigation into a new incremental forming process using an adjustable punch set for the manufacture of a double curved sheet metal," by S. J. Yoon and D. Y. Yang; Korea Advanced Institute of Science of Technology; Taejon, Korea; Feb. 5, 2001.

"Principle and applications of multi-point matched-die forming for sheet metal," by M-Z Li, Z-Y Cai, Z. Sui, and X-J Li, Jilin University, Changchun, People's Republic of China, Jan. 9, 2008.

* cited by examiner

SYSTEM AND METHOD FOR INCREMENTALLY FORMING A WORKPIECE

BACKGROUND

1. Technical Field

The present invention relates to a system and method for incrementally forming a workpiece.

2. Background Art

A method and apparatus for incremental forming is disclosed in U.S. Pat. No. 6,971,256.

SUMMARY

In at least one embodiment, a system for incrementally forming a workpiece is provided. The system includes a fixture assembly that receives a workpiece. A first manipulator is configured to move a first tool in multiple directions along a first surface of the workpiece. The second manipulator is configured to move a second tool in multiple directions along a second surface of the workpiece. The first and second tools move along first and second predetermined paths of motion and exert force to form the workpiece.

In at least one other embodiment, a system for incrementally forming a workpiece having first and second surfaces is provided. The system includes a fixture assembly, a first manipulator, and a second manipulator. The fixture assembly has a clamp that holds the workpiece. The first manipulator is configured to move a first tool along the first surface. The second manipulator is configured to move a second tool along the second surface. The first and second tools move along the first and second surfaces to form the workpiece.

In at least one additional embodiment, a method of incrementally forming a workpiece is provided. The method includes providing a workpiece having first and second surfaces disposed opposite each other. First and second tools are positioned with first and second manipulators such that the first and second tools contact the first and second surfaces. The first and second tools move along first and second rough forming paths to rough form the workpiece. The first and second tools move along first and second finish forming paths to finish form the workpiece.

DETAILED DESCRIPTION

Detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Figure 1:
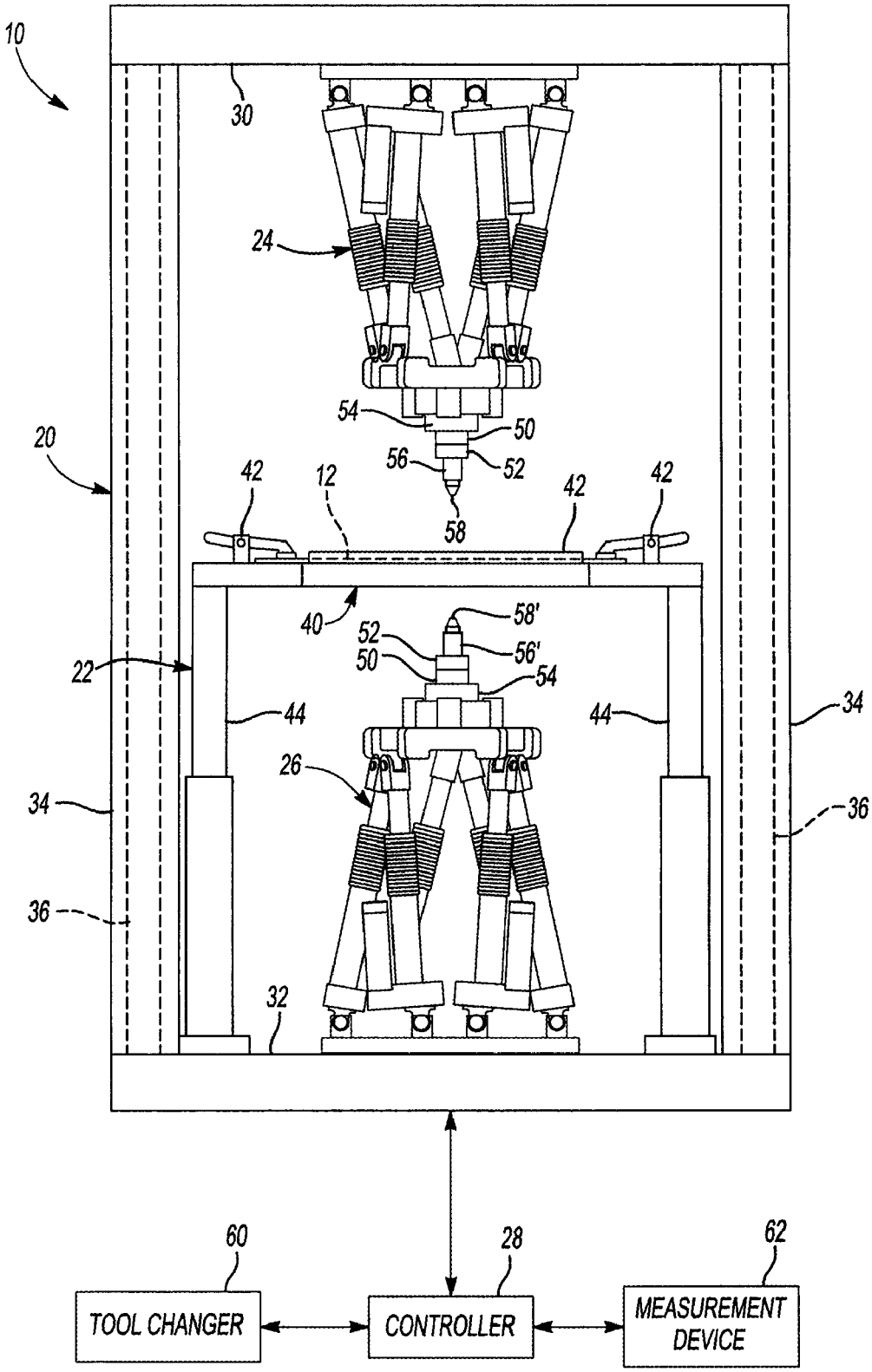
FIG. 1 is a side view of an exemplary system for incrementally forming a workpiece.

Referring to FIG. 1, an exemplary system 10 for incrementally forming a workpiece 12 is shown. The workpiece 12 may be made of any suitable material or materials that have desirable forming characteristics, such as a metal, metal alloy, polymeric material, or combinations thereof. In at least one embodiment, the workpiece 12 may be provided as sheet metal. The workpiece 12 may be generally planar or may be at least partially preformed or non-planar in one or more embodiments of the present invention.

The system 10 may include a support structure 20, a fixture assembly 22, a first manipulator 24, a second manipulator 26, and a controller 28.

The support structure 20 may be provided to support various system components. The support structure 20 may have any suitable configuration. In the embodiment shown in FIG. 1, the support structure 20 has a generally box-like shape. Of course, the present invention contemplates that the support structure 20 may be provided in different configurations having a greater or lesser number of sides. In at least one embodiment, the support structure 20 may be configured as a frame that has first and second platforms 30, 32 that may be disposed opposite each other.

A set of support posts 34 may extend between the first and second platforms 30, 32. The support posts 34 may be provided as solid or hollow tubular members in one or more embodiments. One or more tensile members 36 may be provided to exert force on the support structure 20 to provide a desired amount of stability and rigidity. In at least one embodiment, the tensile members 36 may be provided inside the support posts 34 and may exert a tensile force that biases the first and second platforms 30, 32 toward each other. The tensile members 36 may be of any suitable type, such as compressive cylinders, springs, pretensioned rods, or the like. In at least one embodiment, the force exerted by the tensile members 36 may be adjustable to provide different performance characteristics.

A plurality of openings may be provided between the platforms 30, 32 and support posts 34 that may facilitate access to system components and the installation and removal of the workpiece 12. One or more openings may be at least partially covered with a cover material, such as metal or plexiglass, that helps define an envelope in which workpiece forming occurs. Various safety features may be associated with openings or cover materials to enable or disable system operation in a manner known by those skilled in the art.

The fixture assembly 22 may be provided to support the workpiece 12. The fixture assembly 22 may include a frame that at least partially defines an opening 40. The opening 40 may be at least partially covered by the workpiece 12 when a workpiece 12 is received by the fixture assembly 22. A plurality of clamps 42 may be provided with the fixture assembly 22 to engage and exert force on the workpiece 12. The clamps 42 may be provided along multiple sides of the opening 40 and may have any suitable configuration. For instance, the clamps 42 may be manually, pneumatically, hydraulically, or electrically actuated. Moreover, the clamps 42 may be configured to provide a fixed or adjustable amount of force upon the workpiece 12. For example, one or more clamps 42 may be configured to provide a constant amount of force to hold the workpiece 12 in a fixed position. Alternatively, one or more clamps 42 may be configured to provide an adjustable amount of force to permit a desired amount of material draw with respect to the opening 40.

The fixture assembly 22 may be configured to move with respect to the support structure 20. For example, the fixture assembly 22 may be configured to move toward or away from the first platform 30, the second platform 32, and/or the support posts 34. In FIG. 1, the fixture assembly 22 may move along a vertical or Z axis. In at least one embodiment, the fixture assembly 22 may be mounted on one or more support members 44 that may be configured to extend, retract, and/or rotate to move the fixture assembly 22 and a workpiece 12 with respect to at least one forming tool to help provide an additional range of motion and enhance formability of the workpiece 12. The fixture assembly 22 may move such that it remains parallel to the first or second platforms 30, 32 or such that the fixture assembly 22 tilts to achieve a non-parallel relationship. Movement of fixture assembly 22 may occur when the workpiece 12 is being formed.

The first and second positioning devices or manipulators 24, 26 may be provided to position forming tools. The first and second manipulators 24, 26 may be mounted on the first and second platforms 30, 32, respectively. Alternatively, the first and second manipulators 24, 26 may be directly mounted on the support structure 22 in one or more embodiments of the present invention. The first and second manipulators 24, 26 may have the same or different configurations. For instance, the first and second manipulators 24, 26 may have multiple degrees of freedom, such as hexapod manipulators that may have at least six degrees of freedom, like a Fanuc Robotics model F-200i hexapod robot. Such manipulators may generally have a plurality of prismatic links or struts that joint a base to a platform. The links or struts may be linear actuators, such as hydraulic cylinders that can be actuated to move the platform with respect to the base. A manipulator with six degrees of freedom may move in three linear directions and three angular directions singularly or in any combination. For example, the manipulators may be configured to move an associated tool along a plurality of axes, such as axes extending in different orthogonal directions like X, Y and Z axes.

The first and second manipulators 24, 26 may receive a plurality of components that facilitate forming of the workpiece 12. These components may include a load cell 50, a heating element 52, a spindle 54, a tool holder 56, 56', and a forming tool 58, 58'.

One or more load cells 50 may be provided to detect force exerted on the workpiece 12. Data provided by the load cell 50 may be communicated to the controller 28 and may be used to monitor and control operation of the system 10 as will be described below in more detail. The load cell 50 may be disposed in any suitable location that supports accurate data collection, such as proximate the heating element 52, spindle 54, tool holder 56, 56', or forming tool 58, 58'.

The heating element 52 may be of any suitable type and may be electrical or non-electrically based. The heating element 52 may provide energy that may be transmitted to the workpiece 12 to help provide desired forming and/or surface finish attributes. The heating element 52 may directly or indirectly heat the workpiece 12. For example, the heating element 52 may be provided in or near the forming tool 58, 58' to directly or indirectly heat the forming tool 58, 58' which in turn heats the workpiece 12. In at least one other embodiment, a laser or heating element may directly heat at least a portion of the workpiece 12. Alternatively, one or more heating elements 52 may be disposed on another system component, such as the fixture assembly 22. Heating elements 52 associated with the first and second manipulators 24, 26 may operate simultaneously or independently. In at least one embodiment, operation of one heating element 52 may primarily heat one side of the workpiece 12 and may facilitate differences in stress reduction or surface finish characteristics between different sides or regions of the workpiece 12.

The spindle 54 may be provided to rotate a tool holder 56, 56' and an associated forming tool 58, 58' about an axis of rotation. If provided, the spindle 54 may be mounted on a manipulator 24, 26 and may provide additional material forming capabilities as compared to a forming tool that does not rotate. In addition, the spindle 54 may be actively or passively controlled. Active control may occur by programming or controlling rotation of the spindle 54, which may occur with or without synchronizing spindle motion with movement of a manipulator 24, 26. Passive control may occur by allowing the spindle 54 to freely rotate in response to force exerted against the workpiece 12, such as force transmitted via a forming tool to the spindle 54.

The tool holders 56, 56' may receive and hold a forming tool 58, 58'. The tool holders 56, 56' may have the same or different configurations. The tool holder 56, 56' may include an aperture that may receive a portion of the forming tool 58, 58'. Moreover, the tool holder 56, 56' may secure the forming tool 58, 58' in a fixed position with a clamp, set screw, or other mechanism as is known by those skilled in the art. The tool holder 56, 56' and/or forming tool 58, 58' may also be associated with an automated tool changer 60 that may facilitate rapid interchange or replacement of tools as is also known by those skilled in the art.

The forming tool 58, 58' may impart force to form the workpiece 12. The forming tool 58, 58' may have any suitable geometry, including, but not limited to flat, curved, spherical, or conical shape or combinations thereof. In addition, the forming tool 58, 58' may be configured with one or more moving features or surfaces, such as a roller. Forming tools with the same or different geometry may be provided with the first and second manipulators 24, 26. Selection of the forming tool geometry, hardness, and surface finish attributes may be based on compatibility with the workpiece material and the shape, finish, thickness, or other design attributes desired in the formed workpiece 12.

The one or more controllers 28 or control modules may be provided for controlling operation of the system 10. For example, the controller 28 may monitor and control operation of the fixture assembly 22, manipulators 24, 26, load cell 50, heating element 52, spindle 54, and tool changer 60. The controller 28 may be adapted receive CAD data and provide computer numerical control (CNC) to form the workpiece 12 to design specifications. In addition, the controller 28 may monitor and control operation of a measurement system 62 that may be provided to monitor dimensional characteristics of the workpiece 12 during the forming process. The measurement system 62 may be of any suitable type. For example, measurements may be based on physical contact with the workpiece 12 or may be made without physical contact, such as with a laser or optical measurement system.

As previously stated, the system 10 may be used to incrementally form a workpiece. In incremental forming, a workpiece is formed into a desired configuration by a series of small incremental deformations. The small incremental deformations may be provided by moving one or more tools along or against one or more workpiece surfaces. Tool movement may occur along a predetermined or programmed path. In addition, a tool movement path can also be adaptively programmed in real-time based on measured feedback, such as from the load cell. Thus, forming may occur in increments as at least one tool is moved and without removing material from the workpiece.

Figure 5:
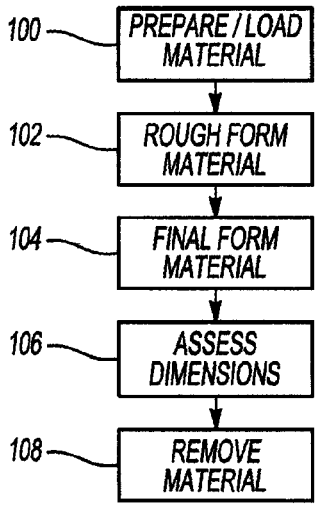
FIG. 5 is a flowchart of a method of incrementally forming a workpiece.

Referring to FIG. 5, an exemplary method of incrementally forming a workpiece is shown.

At 100, the material to be incrementally formed is loaded into the system. The material, which may be at least partially preformed, may be manually or automatically positioned and aligned in the fixture assembly 22 over at least a portion of the opening 40. The workpiece may then be clamped to secure the material in a desired location as previously discussed. In addition, a friction reducing material like wax or a lubricant may be provided on one or more surfaces of the material to be formed to help reduce friction and/or improve finish.

At 102, the material may be "rough formed" or generally formed to an intermediate shape. Rough forming may cause the shape of the material to change such that at least a portion of the workpiece is not formed into a final or target shape. Rough forming may be accomplished by operation of the first and second manipulators 24, 26. For instance, the controller 28 may execute a program to move the manipulators 24, 26 such that their respective tools contact and exert force on the material to change its shape. One or more tools may be used to rough form the material. Use of one tool may result in reduced local deformation control of the workpiece as compared to the use of more than one tool. Use of multiple tools may result in improved dimensional accuracy since forces exerted on one side of the workpiece may be at least partially offset or affected by force exerted by a tool on an opposite side of the workpiece. As such, a one tool may provide localized support that reduces localized movement of the material.

Figure 2:
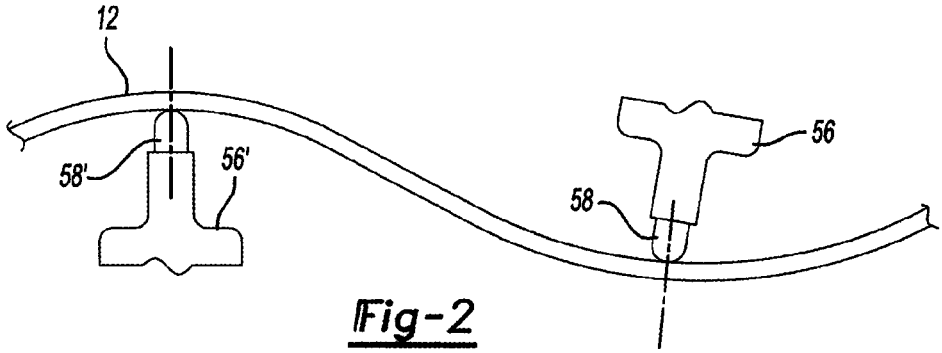
FIGS. 2 and 3 are exemplary side views of a workpiece being formed by the system.

During rough forming, the manipulators may position or move the tools such that they are not in close opposite proximity (i.e., not in close proximity or alignment while being located on opposite or different sides of the workpiece) as is illustrated in FIG. 2. In FIG. 2, the first and second tools 58, 58' are shown exerting force on the workpiece 12 such that a curved surface results. During rough forming, the first and second tools may be moved along the same or different paths and such movement may or may not be synchronized with each other.

Figure 3:
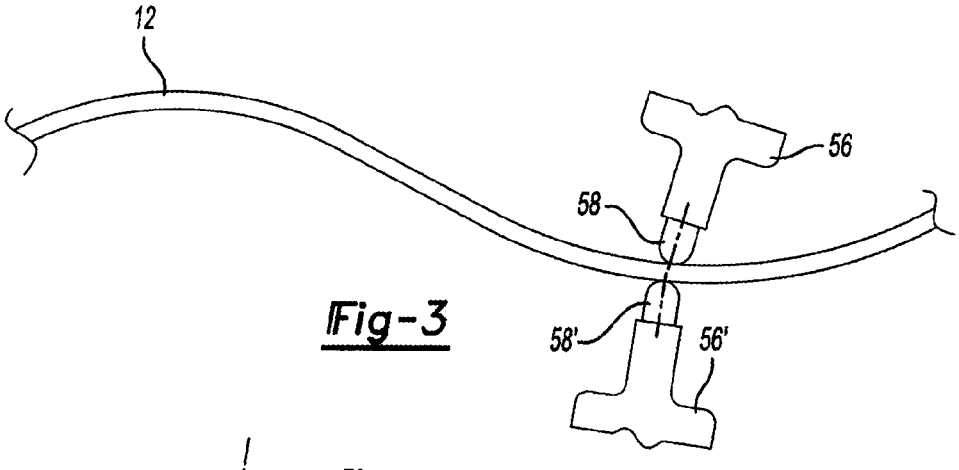

At 104, the material may be "finish formed" such that the final desired shape of the workpiece is attained. Finish forming may compensate for deviations from design intent that may be due to metal relaxation and overall deformation of the workpiece due to rough forming and/or tool positioning or a tool contact position that differs from design intent. Finish forming may occur by actuating the manipulators such that multiple tools are positioned in close opposite proximity with each other (i.e., in close proximity or alignment while being located on opposite or different sides of the workpiece). An exemplary depiction of finish forming is shown in FIG. 3. During finish forming, the deviation from a desired or target shape may be adjusted or corrected by exerting force on different sides of the workpiece such that the force exerted by one tool is at least partially offset or counteracted by the force exerted by another tool. More specifically, the tools may be positioned in sufficiently close proximity to help more precisely control forming of the workpiece. The manipulators may generally move the tools along similar paths to similar locations during finish forming such that sufficient close proximity is attained and/or maintained.

Figure 4:
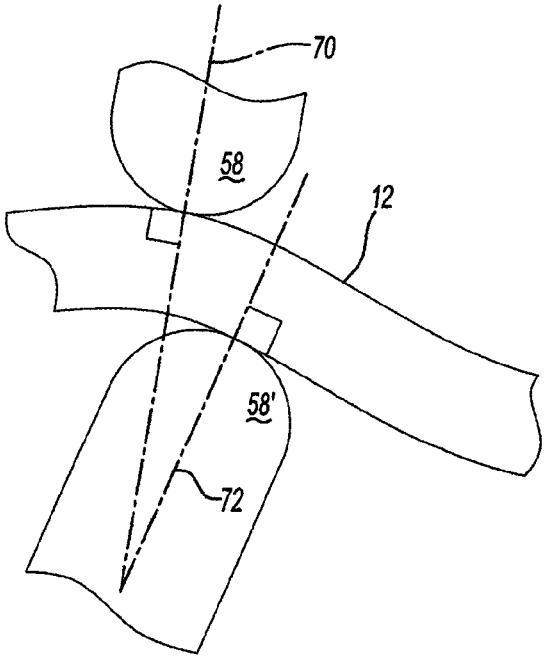
FIG. 4 is a magnified side view of a workpiece being formed by the system.

Referring to FIG. 4, an exemplary illustration of finish forming is shown in more detail. In FIG. 4, the first and second tools 58, 58' contact and exert force on opposite sides of the workpiece 12. The first and second tools 58, 58' are shown in close proximity but on opposite sides of the workpiece 12. A normal axis or normal plane may be associated with each tool. More specifically, a first normal axis 70 is associated with the first tool 58 and a second normal axis 72 is associated with the second tool 58'. Each normal axis or plane extends substantially normal to an associated area of contact with a surface of the workpiece. The normal axes/planes 70, 72 may differ from an axis that extends through the center of the tool and/or an axis of rotation about which a tool may rotate. During finish forming the normal axis or plane of one tool may pass through another tool when the tools are in sufficiently close proximity. In addition, the normal axis or plane of one tool may intersect the normal axis or plane of another tool along at least a portion of the path of movement. The point or line of intersection may occur within one of the tools when the tools are placed within sufficient close opposite proximity. For example, the first and second normal axes/planes 70, 72 may pass through or intersect within the second tool 58' as shown in FIG. 4. Moreover, the first and second normal axes may not intersect during rough forming or when the first and second tools are not within sufficiently close proximity.

At 106, the dimensions of the formed workpiece may be assessed. Dimensional assessment may be accomplished using a measurement system as previously discussed. If one or more dimensional characteristics are not within a predetermined tolerance then additional forming operations may be executed and/or programming adjustments may be made.

At 108, the finished workpiece may be removed from the system. More specifically, the clamps may be released and disengaged from the workpiece such that the material can be removed from the fixture assembly.

The present invention may be employed to form a workpiece with complex geometries without incurring the costs and lead time associated with the design, construction, and transportation of dies that have historically been employed to form workpieces like sheet metal. Moreover, capital investment in associated equipment (e.g., presses) may be reduced or avoided. As such, the cost per piece and time to production may be substantially reduced. Moreover, the present invention may produce a part with improved surface quality and dimensional accuracy as compared to other techniques, such as single point incremental forming. Additionally, energy consumption may be reduced. Such advantages may be realized in prototyping, small volume production, and/or higher volume production operations.

While the best mode for carrying out the invention has been described in detail, those familiar with the art to which this invention relates will recognize various alternative designs and embodiments for practicing the invention as defined by the following claims.

What is claimed:

1. A system for incrementally forming a workpiece, the system comprising:

a fixture assembly that receives a workpiece, the workpiece having a first surface and a second surface disposed opposite the first surface;

a first manipulator configured to move a first tool in multiple directions along the first surface; and a second manipulator configured to move a second tool in multiple directions along the second surface;

wherein the first and second tools move along first and second predetermined paths of motion and exert force without penetrating the first and second surfaces to form the workpiece.

2. The system of claim 1 further comprising a support structure having first and second platforms that support the first and second manipulators, respectively, wherein the support structure includes a tensile member that exerts a tensile force that biases the first and second platforms toward each other.

3. The system of claim 1 wherein the first predetermined path of motion differs from the second predetermined path of motion.

4. The system of claim 1 wherein the fixture assembly defines an opening and includes a clamp that holds a portion of the workpiece in a stationary position with respect to the fixture assembly such that the workpiece covers the opening.

5. The system of claim 1 further comprising first and second tool holders that receive the first and second tools, respectively, and first and second spindles disposed on the first and second manipulators, respectively, wherein the first spindle is configured to rotate the first tool about a first axis of rotation and the second tool holder is configured to rotate the second tool about the second axis of rotation when at least a portion of the workpiece is being formed.

6. The system of claim 1 wherein the first and second tools move simultaneously to form the workpiece.

7. The system of claim 1 further comprising first and second heating elements disposed proximate the first and second manipulators, respectively, wherein the first and second heating elements provide energy to heat the workpiece.

8. The system of claim 7 wherein an amount of energy provided by the first heating element differs from an amount of energy provided by the second heating element.

9. A system for incrementally forming a workpiece having first and second surfaces disposed opposite each other, the system comprising: a fixture assembly having a clamp that holds the workpiece; a first manipulator configured to move a first tool along multiple axes along the first surface; and a second manipulator configured to move a second tool along multiple axes along the second surface; wherein the first and second tools form the workpiece when they move along the first and second surfaces without penetrating the first and second surfaces to form the workpiece.

10. The system of claim 9 wherein the first and second manipulators move the first and second tools such that the first tool is not disposed directly opposite the second tool to rough form at least a portion of the workpiece.

11. The system of claim 9 wherein the first tool has a first normal axis of contact with the first surface, the second tool has a second normal axis of contact with the second surface, and the first and second normal axes do not intersect during rough forming of the workpiece.

12. The system of claim 9 wherein the first and second manipulators move the first and second tools such that the first tool is disposed substantially opposite the second tool to finish form at least a portion of the workpiece after rough forming of the workpiece.

13. The system of claim 12 wherein the first tool has a first normal axis of contact with the first surface, the second tool has a second normal axis of contact with the second surface, and the first and second normal axes intersect during finish forming of the workpiece.

14. The system of claim 9 wherein the fixture assembly moves the workpiece when at least one of the first and second tools is in contact with the workpiece.

15. A method of incrementally forming a workpiece, the method comprising:

providing a workpiece having first and second surfaces disposed opposite each other;

positioning first and second tools with first and second manipulators that are configured to move the first and second tools along multiple axes such that the first and second tools contact the first and second surfaces; and moving the first and second tools along first and second forming paths to form the workpiece such that the first and second tools do not penetrate the first and second surfaces.

16. The method of claim 15 wherein moving the first and second tools further comprises moving the first and second tools along first and second rough forming paths to rough form the workpiece; and moving the first and second tools along first and second finish forming paths to finish form the workpiece.

17. The method of claim 16 further comprising assessing dimensional characteristics of the workpiece after moving the first and second tools along first and second finish forming paths to finish form the workpiece.

18. The method of claim 16 wherein the first tool has a first normal axis of contact with the first surface, the second tool has a second normal axis of contact with the second surface, and the first normal axis passes through the second tool or the second normal axis passes through the first tool when the first and second tools are moved along the first and second finish forming paths.

19. The method of claim 16 wherein the first tool is not disposed substantially opposite the second tool when the first and second tools move along the first and second rough forming paths and the first tool is disposed substantially opposite the second tool when the first and second tools move along the first and second finish forming paths.

20. The method of claim 16 further comprising moving the workpiece while at least one of the first and second tools is in contact with the workpiece.

* * * * *